US005838285A

United States Patent [19]

Tay et al.

[11] Patent Number: 5,838,285

[45] Date of Patent: Nov. 17, 1998

[54] WIDE BEAMWIDTH ANTENNA SYSTEM AND METHOD FOR MAKING THE SAME

[75] Inventors: Roger Yew-Siow Tay, Sunrise; Oscar M. Garay, Coral Springs; Quirino Balzano, Plantation, all of Fla.

[73] Assignee: Motorola, Inc., Schaumburg, Ill.

[21] Appl. No.: 841,022

[22] Filed: Apr. 29, 1997

Related U.S. Application Data

[63] Continuation-in-part of Ser. No. 567,698, Dec. 5, 1995, abandoned.

[51] Int. Cl.[6] ..... H01Q 11/08

[52] U.S. Cl. ..... 343/895; 343/700 MS; 343/853

[58] Field of Search ..... 343/895, 700 MS, 343/897, 825, 826, 829, 846, 848, 850, 853; H01Q 11/08

[56] References Cited

U.S. PATENT DOCUMENTS 5,075,691 12/1991 Garay et al. ..... 343/830
5,134,422 7/1992 Auriol ..... 343/897
5,198,831 3/1993 Burrell et al. ..... 343/895
5,485,170 1/1996 McCarrick ..... 343/895

*Primary Examiner*—Hoanganh T. Le
*Attorney, Agent, or Firm*—Val Jean F. Hillman

[57] ABSTRACT

A wide beamwidth antenna system (100) having a number of monopole antenna elements (102–108) disposed on at least one surface (111,113) of a single, flexible dielectric substrate (101), a number of antenna feed members (110–116), disposed on the first surface (111) of the dielectric substrate (101), each antenna feed member (110–116) being respectively coupled to one of the monopole antenna elements (102–108), a system feed member (118), disposed on the first surface (111) of the dielectric substrate (101), a first power splitter (120), disposed on the first surface (111) of the dielectric substrate (101) and coupled between the system feed member (118) and the first one of the monopole antennae (102) and a first phase shifter (130), disposed on the first surface (111) of the dielectric substrate (101) and coupled between the first (102) and the second (104) monopole antennae. A ground plane (140) is disposed on a portion of the second surface (113) of the dielectric substrate (101).

19 Claims, 8 Drawing Sheets

WIDE BEAMWIDTH ANTENNA SYSTEM AND METHOD FOR MAKING THE SAME

This is a continuation of application Ser. No. 08/567,698, filed Dec. 5, 1995, and now abandoned.

FIELD OF THE INVENTION

This invention relates generally to antennae, more specifically to micro-strip circuits and particularly to a circularly polarized antenna system and a method for making the same.

BACKGROUND OF THE INVENTION

For portable communication devices, such as two-way radios and pagers, the current industry trend is toward product miniaturization. While radio components, amplifiers, filters, integrated circuits (ICs) and the like have experienced radical size reductions in the past 50 years, similar gains in the antenna art have lagged well behind. Not surprisingly therefore, one of the largest components in a typical radio today is the antenna.

One relatively recent and promising development in the battle to reduce overall antenna size has been the introduction of micro-strip technology into antenna design; namely, affixing miniature resonators on a dielectric substrate having a ground plane. While this approach has proven useful in applications where narrow beamwidth transmissions are common, it will be appreciated by those skilled in the art that, the typical micro-strip antennae are extremely intricate devices to manufacture and have limited application where broad beamwidth transmissions are anticipated. Broad beamwidth transmissions are common place in applications such as, for example, ground-to-satellite communications.

As is known, quadrafilar, cross dipole, end-fire helix and patch antennae are some of the antenna types used in ground-to-satellite communications. These antennae are typically employed because they exhibit one or more characteristic desirable in ground-to-satellite applications; namely, broad beamwidth transmission, high gain, high efficiency and/or circularly polarized transmissions. Despite their individual strengths, each nevertheless has serious limitations. For example, while quadrafilar antennae typically exhibit broad beamwidth radiation patterns, high gain and are capable of providing circularly polarized transmissions, they are extremely expensive, difficult to manufacture and therefore unsuitable for many applications. While cross-dipole antennae exhibit broad beamwidth transmissions, medium gain and are capable of providing circularly polarized transmissions, they are plagued by large back lobe radiation which robs their efficiency. While end-fire helix antennae exhibit high gain, they typically exhibit relatively narrow beamwidth transmission. While patch antennae are typically inexpensive and easy to manufacture, they to exhibit relatively narrow beamwidth transmissions.

Based on the foregoing, it would be extremely advantageous to provide a micro-strip antenna system that is inexpensive, easy to manufacture and well suited for ground-to-satellite communications; namely, exhibiting broad beamwidth transmissions, high gain, high efficiency and circularly polarized transmissions.

DETAILED DESCRIPTION OF THE PREFERRED EMBODIMENT

Figure 1:
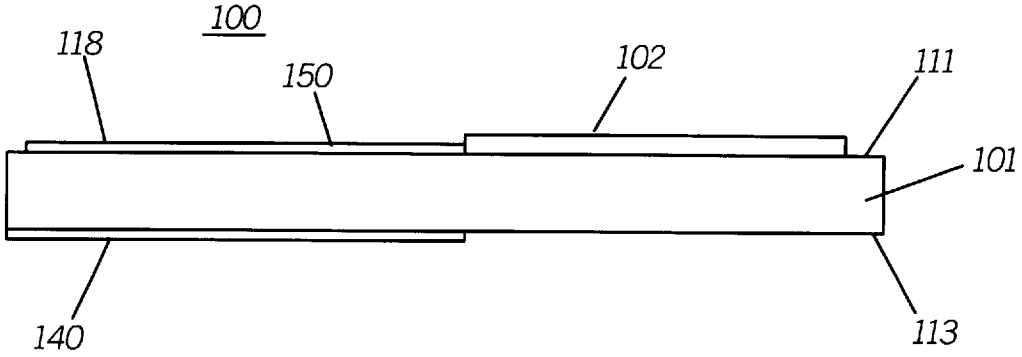
FIG. 1 depicts a side elevational view of an antenna in accordance with the present invention.

FIG. 1 is a side view of the antenna in accordance with the present invention. Using conventional printed circuit board techniques, metal is deposited on a surface 113 of a dielectric substrate 101 to form a ground plane 140. The substrate 101 is preferably made from a flexible, low loss, low dielectric material such as TEFLON™. It will none the less be appreciated by those skilled in the art that substrate 101 may be made from any other flexible, low loss, low dielectric material, such as, but not limited to: Polyimides or Polyethylenes.

As will hereafter be appreciated, it is an important feature of the present invention that the dielectric material be flexible or at least capable of being bent when placed under tension. It is not, however, essential to the invention that the dielectric material take its original shape when tension is removed. In fact, depending upon the particular application it may be desirable that the dielectric material be selected from a group of materials that are flexible when under tension and remain rigid when such tension is removed.

Figure 2:
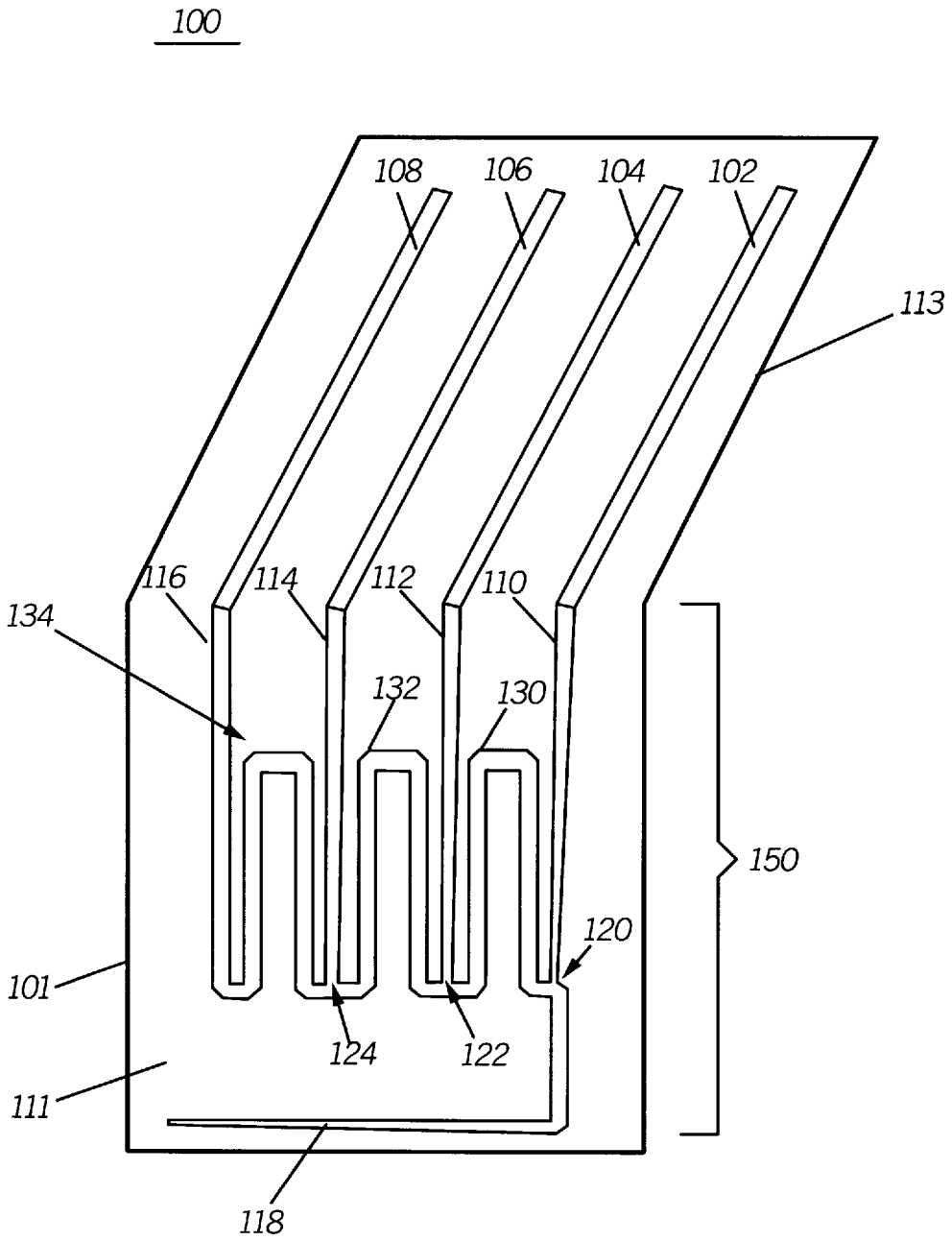
FIG. 2 is plan view of the antenna of FIG. 1.

Located on another surface 111 of the dielectric substrate 101 and across from i.e., juxtaposed from ground plane 140 is an antenna feed system 150 comprised in part of conductive traces forming a system feed member 118 and a number of antenna feed members 110–116, as show and described in more detail herein in accordance with FIG. 2.

Referring back to FIG. 1, a metal pattern 102 is deposited on a portion of the surface 111 of the dielectric substrate 101 that does not overlay and is not in distal proximity to ground plane 140. As will be appreciated by those skilled in the art, ground plane 140 antenna feed system 150 and metal pattern 102 may be formed by any number of well known deposition, etch, photolithographic or thin-film processing techniques.

With reference to FIG. 2, there is shown a top or plan view of the antenna of FIG. 1. As will be appreciated, dielectric substrate 101 is configured initially as a flat sheet with conductive traces disposed thereon. As seen from this view, the antenna of FIG. 1 is a multipole antenna system 100 having a number of monopole antennae 102–108 disposed on surface 111 of dielectric substrate 101. Conductive trace 118, forming a system feed member, is provided in order to feed the antenna system 100 with a radio frequency (RF) power signal $P_{in}$. Disposed between antenna feed member 118 and the plurality of monopole antennae 102–108 is the antenna feed system 150 of FIG. 1.

Antenna feed system 150 comprises in part conductive traces that define: a number of antenna feed members 110–116, each respectively coupled to one of the monopole antennae 102–108; a first power splitter 120, coupled between the system feed member 118 and the first monopole antennae 102; a first phase shifter 130, coupled between the first 102 and second 104 monopole antennae; a second power splitter 122, coupled between the first phase shifter 130 and the second monopole antenna 104; a second phase shifter 132, coupled between the second 104 and third 106 monopole antennae; a third power splitter 124, coupled between the second phase shifter 130 and the third monopole antenna 106; and a third phase shifter 134, coupled between the third 106 and fourth 108 monopole antennae. As previously mentioned, ground plane 140 is disposed on a portion of the surface 113 of the dielectric substrate 101 across from the antenna feed system 150.

While the present embodiment teaches four (4) monopole antennae, it will be appreciated by those skilled in the art that the present invention can be used with N monopoles antenna, where N is an integer number greater than one (1). In accordance, with the present invention, there will always be in association therewith N−1 phase shifters and N−1 power splitters.

During operation, RF power signal, $P_{in}$, is feed to antenna system 100 by antenna feed member 118. The first power splitter 120 operates to direct some of the RF power, Pin, to the first monopole antenna 102. The RF power signal, $P_1$, directed to antenna 102 is in phase with the RF power signal $P_{in}$ and is determined by:

$$P_1=(1/N)\cdot P_{in} \quad 1)$$

where N is an integer value greater than 1 and equal to the number of monopole antennae. The remaining RF power signal, $P_{out-1}$, is then fed forward to the first phase shifter 130.

The first phase shifters 130 shifts the phase of the received RF power signal, $P_{out-1}$, by 360°/N, where N is an integer value greater than 1 and equal to the number of monopole antennae. In accordance with the present embodiment, each phase shifter 130, 132 and 134 provides a 90° shift in phase to the RF signals communicated to monopole antennae 104, 106 and 108.

From the first phase shifter 130, the phase shifted RF power signal $P_{out-1}$, is feed to the second power splitter 122. The second power splitter 122 operates to direct some of the RF power, $P_{out-1}$, to the second monopole antenna 104. The RF power signal, $P_2$, directed to antenna 104 is determined by:

$$P_2=(1/(N-1))\cdot P_{out-1} \quad 2) \text{ or}$$

$$P_2=(1/(N-1))\cdot(P_{in}-P_1) \quad 3)$$

The remaining RF power signal, $P_{out-2}$, is then fed forward to the second phase shifter 132. As previously mentioned, the second phase shifter 132 operates to shift the phase of RF power signal, $P_{out-2}$, by 90° prior to delivery to monopole 106.

From the second phase shifter 132, the phase shifted RF power signal $P_{out-2}$, is feed to third and final power splitter 124 of the preferred embodiment. Third power splitter 124 operates to direct some of the RF power of signal $P_{out-2}$ to the third monopole antenna 106. The RF power signal, $P_3$, directed to antenna 106 is determined by:

$$P_3=(1/(N-2))\cdot(P_{in}-(P_1+P_2)) \quad 4)$$

The remaining RF power signal, $P_{out-3}$, is then fed forward to the third phase shifter 134, which operates to shift the phase of RF power signal, $P_{out-3}$, by 90° prior to delivery to monopole 108. Since this system of antenna feeding can be applied to any integer number, N, of monopole antennae, a general formula to be used in the alternative is:

$$P_m=(1/N-(m-1))\left(P_{in}\sum_{i=1}^{m-1}P_i\right) \quad 5)$$

where m<N.

A feature of the antenna system 100 of FIG. 2 is that the system feed member 118 has integrated therein, an impedance transformer. In accordance with the preferred embodiment, the impedance transformer is constructed by tapering the width of the conductive trace that defines the system feed member 118. Tapering the width W of a conductive trace, such as, for example system feed member 118, having a length L and a constant thickness H, operates to change the impedance characteristic exhibited by the conductive trace over the length L. By design, the impedance transformer of system feed member 118 operates to provide impedance matching.

Yet another feature of the antenna system 100 as shown in FIG. 2 is that each antenna feed member 110, 112 and 114 has integrated therein, an. impedance transformer. In accordance with the preferred embodiment, the impedance transformer is once again constructed by tapering the width of the conductive traces that define each antenna feed member 110, 112 and 114. As previously discussed, the purpose of the impedance transformer is to provide the necessary impedance matching.

Figure 3:
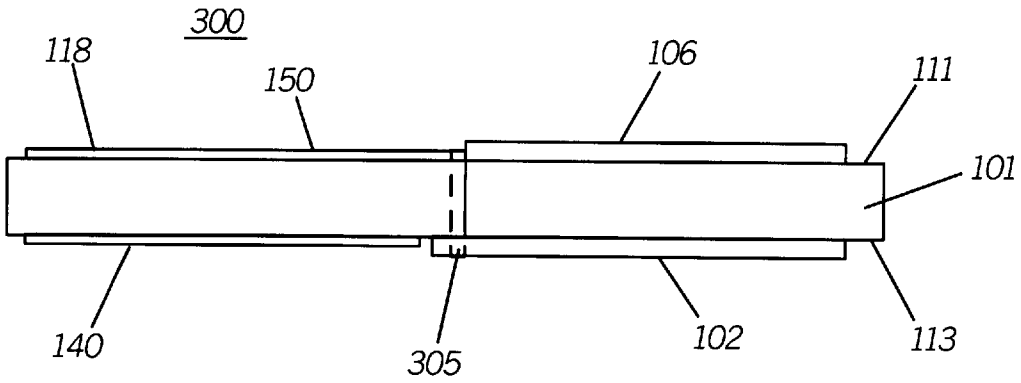
FIG. 3 is a side elevational view of an alternate embodiment of the antenna of FIG. 1.

FIG. 3 is a side view of an alternate embodiment of an antenna in accordance with the present invention. Upon review, it will be appreciated that the embodiment disclosed in FIG. 3 is substantially similar to the embodiment disclosed and described in association with FIG. 1. In accordance, elements common to FIG. 1 and FIG. 3 bear identical reference numbers. The remainder of this discussion will concentrate on the differences between the two embodiments.

The multipole antenna system 300 of FIG. 3 depicts a system wherein monopole antennae 106 and 108 are disposed on the first surface 111 of the dielectric substrate 101. Monopole antennae 102 and 104 are disposed on the second surface 113 of the dielectric substrate 101. Monopole antennae 102 and 104 are coupled to the antenna feed system 150 by way of conductive vias 305 and 307 as shown in FIGS. 3 and 4.

Figure 4:
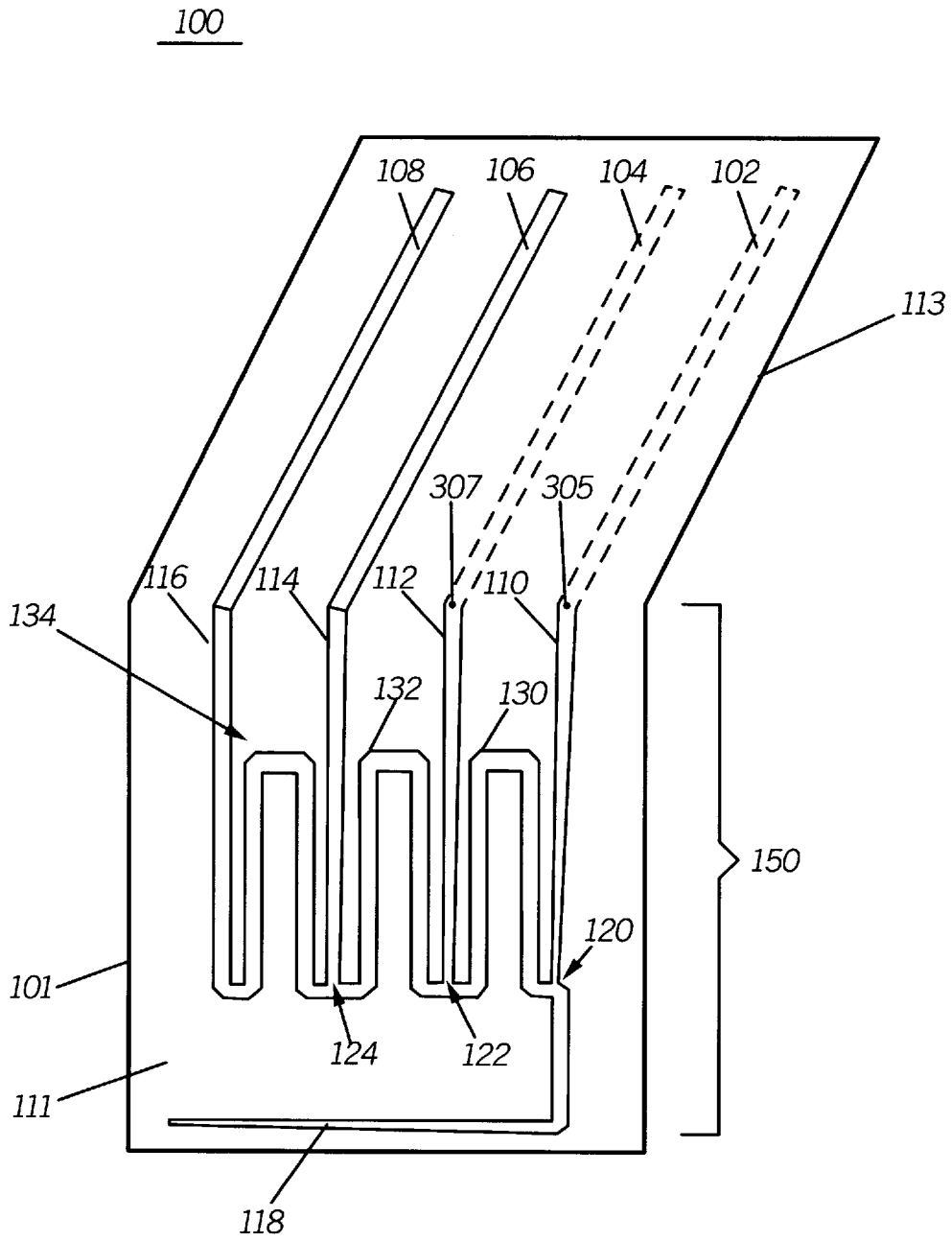
FIG. 4 is a plan view of the antenna of FIG. 3.

FIG. 4 is a top or plan view of the antenna of FIG. 3 depicting monopole antennae 102 and 104 disposed on the second surface 113 of substrate 101. As will be appreciated, dielectric substrate 101 is again configured initially as a flat sheet with conductive traces disposed thereon. As previously mentioned, conductive vias 305 and 307, respectively couple monopole antennae 102 and 104 to the antenna feed system 150.

Figure 5:
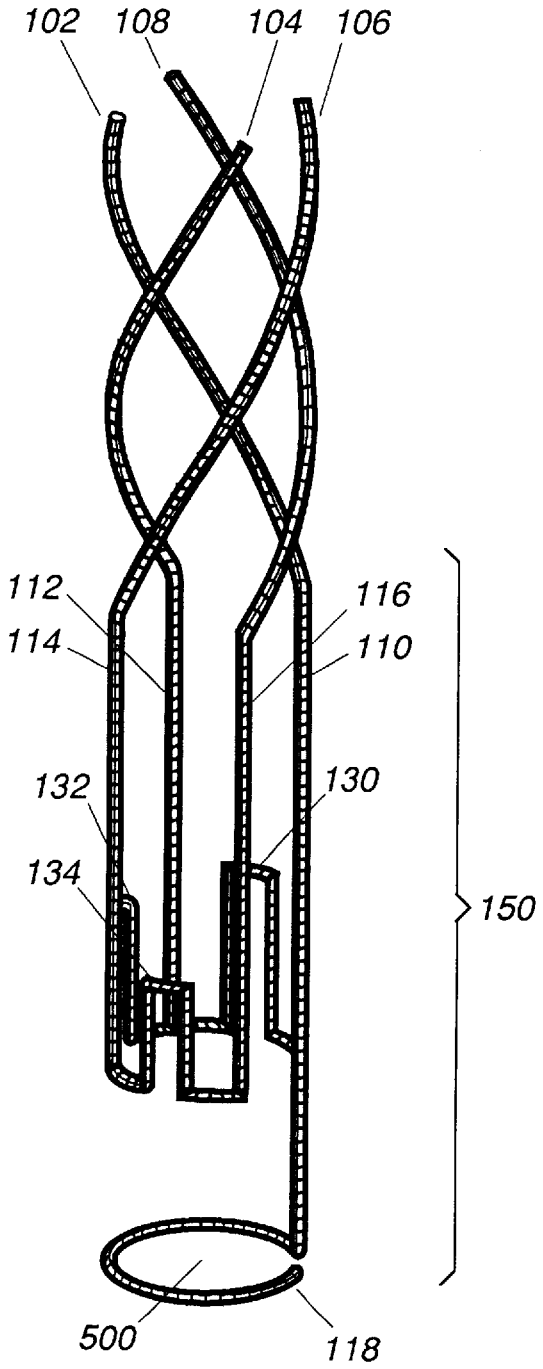
FIG. 5 is a perspective view of the antennae of FIGS. 1–4.

FIG. 5 is a perspective view of the antennae of FIGS. 1–4. FIG. 5 illustrates that the formation of substrate 101 into a tubular configuration has the effect of presenting the antenna elements 102–108 in a spiral configuration. Formation of substrate 101 into a tubular configuration also has the effect of causing system feed member 118 to conform to the shape of a circular loop 500. Of note, dielectric substrate 101 and ground plane 140 are not shown in FIG. 5 for the sake of clarity.

In accordance with the preferred embodiment, circular loop 500 acts as an energy director. During operation, energy director 500 acts to redirect the RF energy attempting to exit the antenna system via system feed member 118. As an alternative to circular loop 500, system feed member 118 may comprise an energy director formed as a plurality of bends, such as, for example, when substrate 101 is formed into the shape of a triangle or a parallelogram.

To make the antenna system 100 of the present invention as shown in FIGS. 1–5, conventional printed circuit board techniques such as, but not limited to etching, plating, printing and photolithography are used in order to dispose N conductive monopole antennae 102–108 on at least one surface of a flexible dielectric substrate 101, where N is an integer greater than one (1). Thereafter, a system feed member 118, fashioned from conductive traces, is disposed on a first surface 111 of the flexible dielectric substrate 101. At least one power splitter 120, fashioned from conductive traces, is disposed on the first surface 111 of the flexible dielectric substrate 101, said power splitter 120 being coupled between the system feed member 118 and at least one of the N conductive monopole antennae 102–108. N−1 phase shifters 130, fashioned from conductive traces, are disposed on the first surface 111 of the flexible dielectric substrate 101, each of said N−1 phase shifters 130 is coupled between two of said N monopole antennae 102–108. Finally, ground plane 140 (not shown in FIG. 5) is disposed on at least a portion of the second surface 113 of the flexible dielectric substrate 101. In accordance with the preferred embodiment, ground plane 140 is disposed on that portion of the second surface 113 of the flexible dielectric substrate 101 that is juxtaposed to the position of the antenna feed system 150 of FIGS. 1 and 3.

Figure 6:
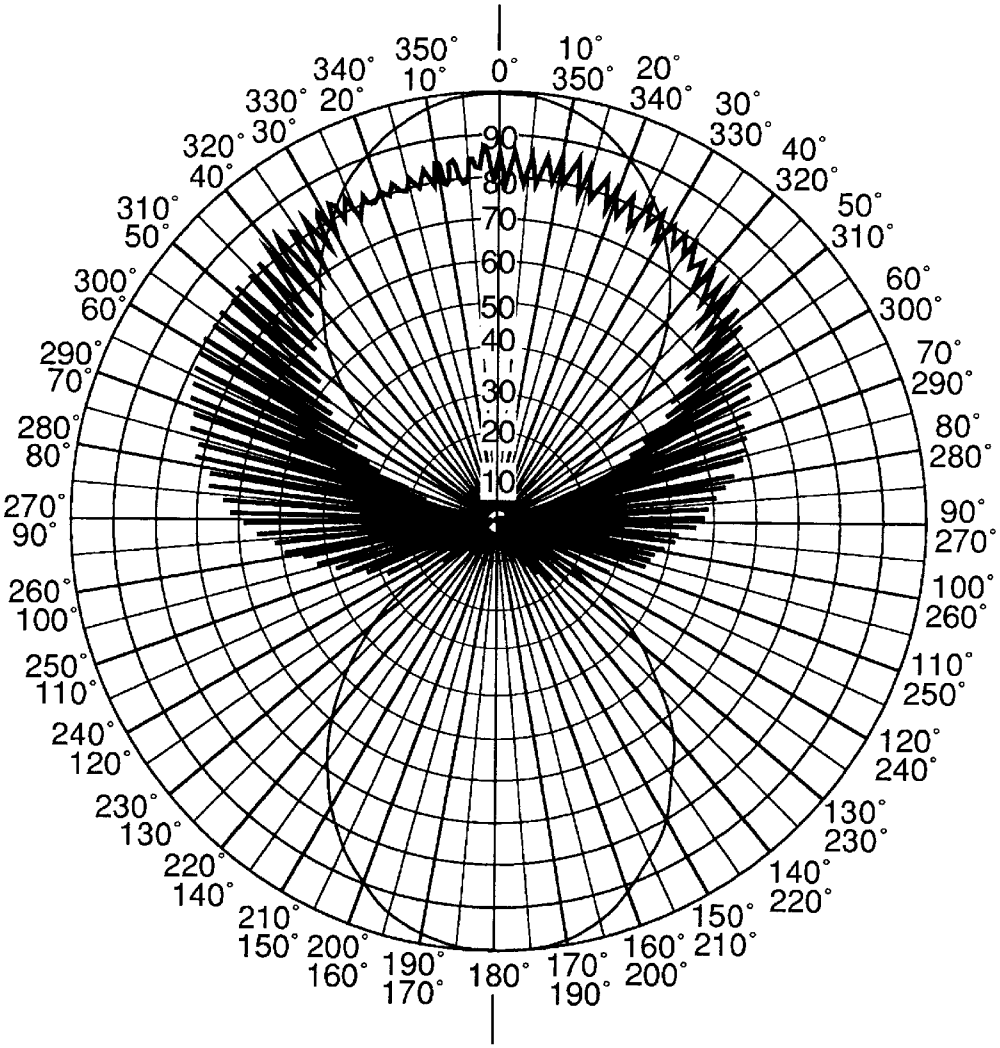
FIG. 6 depicts the radiation pattern of the antenna of FIG. 5.

FIG. 6 depicts the radiation pattern of antenna 100 of FIG. 5, when excited with a radio frequency (RF) signal such as that supplied by the typical RF transceiver. Since such RF transceivers and their operation are well within the knowledge and understanding of those skilled in the art, no further discussion will be provided. The interested reader may nevertheless refer to "Electronics Engineers' Handbook" Second Edition, Chapter 22, McGraw-Hill Book Co., 1982 for additional information.

Upon review, it will be appreciated by those skilled in the art that the radiation pattern depicted in FIG. 6 is characteristic of an array of circularly polarized monopole antennae; namely, it exhibits broad radiation beamwidth and high gain as compared to the E-plane cut of a dipole antenna. In addition, it will be noted that the primary energy lobes associated with transmissions received by or transmitted from antenna 100 are primarily oriented along the Z (Zenith) axis. These characteristics are particularly desirable for an antenna used during ground-to-satellite communications when the satellite is overhead.

Figure 7:
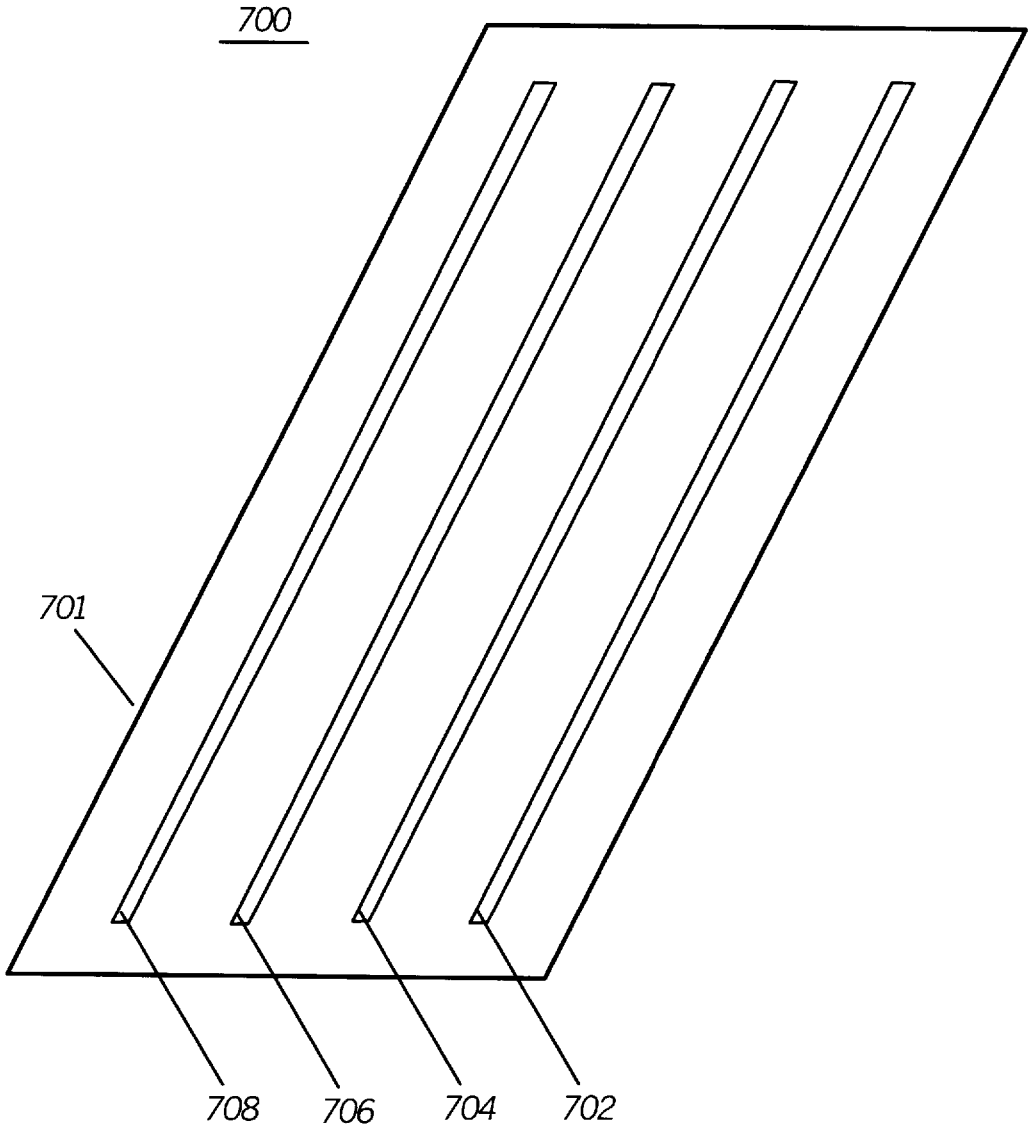
FIG. 7 is a plan view of a beam steering device in accordance with the present invention.

FIG. 7 is a top or plan view of a beam steering device 700 for use with the antenna of FIG. 5. As shown, devices 700 comprises N equally spaced end-fed half wave dipole antennae 702–708 disposed on at least one surface of flexible dielectric substrate 701. As will be appreciated, dielectric substrate 701 is preferably made from a flexible, low loss, low dielectric material such as TEFLON™, and is configured initially as a flat sheet. To make the beam steering device 700 of the present invention, conventional printed circuit board techniques such as, but not limited to etching, plating, printing and photolithography are used in order to dispose N conductive dipole antennae 702–708 on at least one surface of the flexible dielectric substrate 701, where N is an integer greater than 1.

Figure 8:
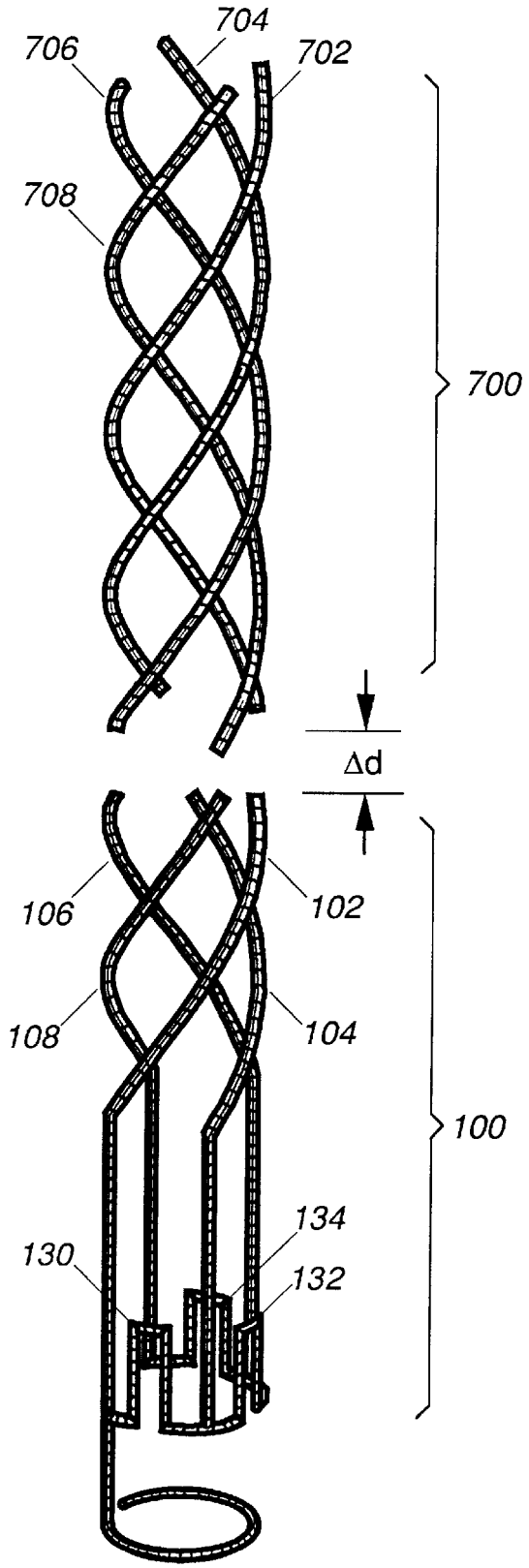
FIG. 8 is a perspective view of the beam steering device of FIG. 7.

FIG. 8 is a perspective view showing the combination of beam steering device 700 of FIG. 7 and the antenna 100 of FIG. 5. Of note, substrate 101, 701 and ground plane 140 are not shown in FIG. 8 for the sake of clarity. FIG. 8 is presented to illustrates that the formation of substrates 101 and 701 in tubular configurations has the effect of presenting the antenna elements 102–108 and 702–708 in a spiral configuration.

In accordance with the present invention, antenna 100 will operate to feed beam steering device 700 when beam steering device 700 and antenna 100 are in distal proximity one to the other such that electrical coupling between the monopoles 102–108 of antenna 100 and the dipoles of beam steering device 700 is achieved. During operation, each dipole 702–708 must receive an RF signal from antenna elements 102–108 that are of equal power and ninety degrees 90° out of phase one from another in order to achieve circularly polarized transmission and reception.

Since antenna 100 and beam steering device 700 are presented in a tubular configuration, each will have a diameter D. By making the diameter of one smaller than the diameter of the other, the two devices are mechanically mated by sliding one inside the other. Electrical coupling is achieved when the monopole antennae 102–108 and dipole antennae 702–708 are aligned, as shown in FIG. 8, and the coupling gap distance Δd is small.

By way of example, when the coupling gap distance, Δd, between monopoles antenna 102–108 and dipole antennae 702–708 is large, electrical coupling between these antenna elements will be small. Under this circumstance, the device combination, as presented in FIG. 8, will be predominated by the array of monopole antennae 102–108. The resultant radiation pattern exhibited by the device combination will conform substantially to the radiation pattern depicted in FIG. 6. Conversely, when the coupling gap distance, Δd, between monopole antenna 102–108 and dipole antenna 702–708 is decreased, electrical coupling between these antennae elements will increase. As the electrical coupling increases, antenna 100 will begin to behave as an impedance transformer, transferring RF energy from monopole elements 102–108 to dipole elements 702–708. Under this circumstance, the device combination, as presented in FIG. 8, will become predominated by the array of dipole antennae 702–708. The resultant radiation pattern exhibited by the device combination will conform substantially to the radiation pattern depicted in FIG. 9. Thus, by changing the coupling gap distance Δd, one can alter and/or optimize the energy transfer between monopole elements 102–108 and dipole elements 702–708 to change the antenna radiation pattern from an array of monopole antennae to an array of dipole antennae. The net effect of this operation is the ability to steer the placement or select deployment of energy lobes associated with an array of monopole or an array of dipole antenna elements.

Figure 9:
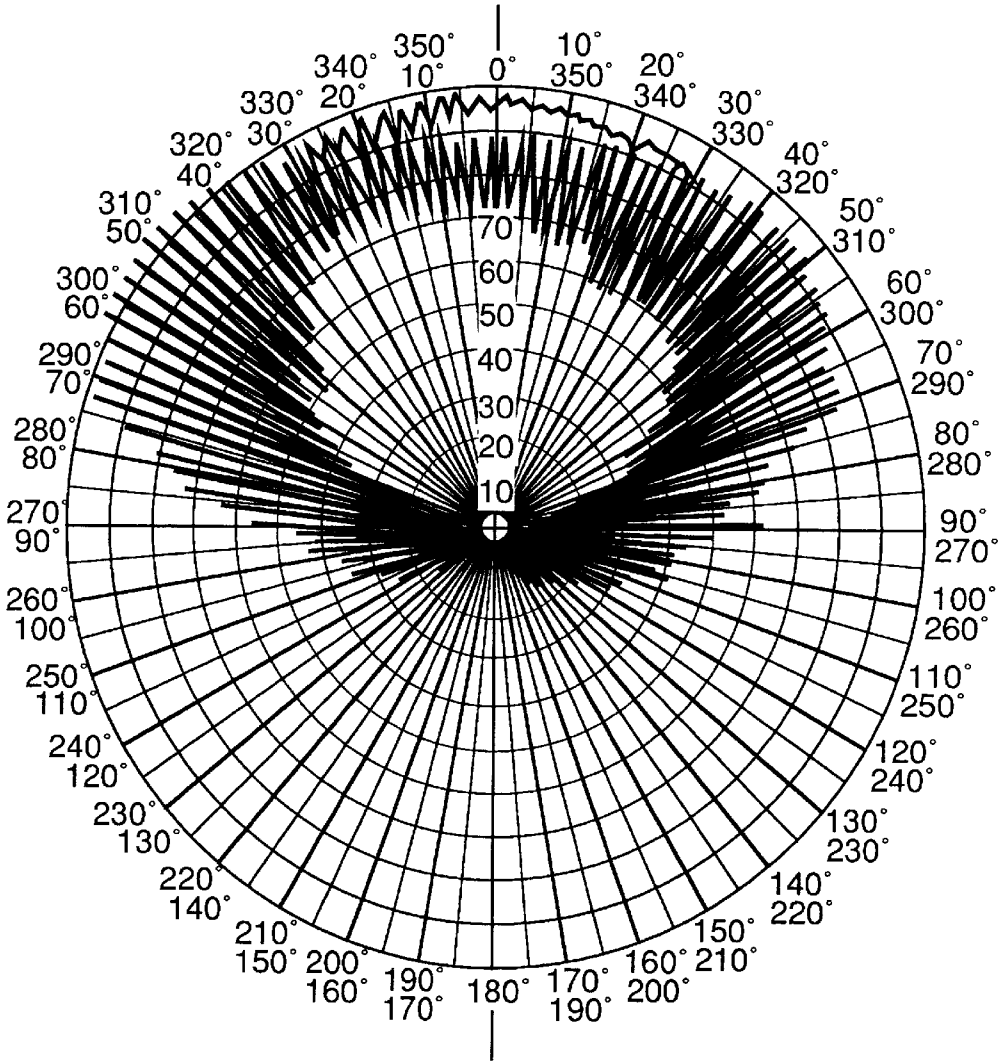
FIG. 9 depicts the radiation pattern of the antenna of FIG. 5 when coupled to the beam steering device of FIG. 7.

FIG. 9 depicts the radiation pattern of the antenna of FIG. 5 when coupled to the beam steering device 700 of FIG. 8. Upon review of the radiation pattern depicted in FIG. 9, it will be appreciated by those skilled in the art that it is characteristic of the radiation pattern associated with an array of dipole antennae; namely, it exhibits broad radiation beamwidth and high gain. Due to the tubular configuration of substrate 701, antenna 700 also supports circularly polarized transmissions. In addition, it will be noted that the primary energy lobes associated with transmissions received by or transmitted from antenna 700 are primarily oriented along the X, Y plane. As will be appreciated, these characteristics are desirable for an antenna to be used during ground-to-satellite communications when the satellite is nearing a horizon.

What is claimed is:

1. A wide beamwidth antenna system for communicating signals to and receiving signals from a communications device, said wide beamwidth antenna system comprising:

a single flexible dielectric substrate having a first and a second surface and presenting an elongated, tubular portion;

a plurality of monopole antennae, without short circuit connection, disposed on a surface of the dielectric substrate;

an antenna feed system, disposed on the first surface of the dielectric substrate for feeding the antenna system with an RF power signal; and a ground plane disposed on the second surface of the single dielectric substrate and juxtaposed to the antenna feed system.

2. The wide beamwidth antenna system of claim 1 wherein the ground plane is disposed on the second surface of the dielectric substrate and not in juxtaposed position to the plurality of monopole antennae.

3. The wide beamwidth antenna system of claim 1 wherein the antenna feed system comprises:

a plurality of antenna feed members, disposed on the first surface of the dielectric substrate, each of said plurality of antenna feed members, respectively coupled to one of said plurality of monopole antennae;

a system feed member, disposed on the first surface of the dielectric substrate, for feeding the antenna system with the RF power signal;

a power splitter, disposed on the first surface of the dielectric substrate and coupled between the system feed member and a first one of said plurality of monopole antennae; and a phase shifter, disposed on the first surface of the dielectric substrate, said first phase shifter being coupled between the first and a second one of said plurality of monopole antennae.

4. The wide beamwidth antenna system of claim 3 wherein the first power splitter directs at least some of the RF power to the first one of said plurality of monopole antennae, a remaining RF power signal being fed forward.

5. The wide beamwidth antenna system of claim 3 wherein the first phase shifter shifts the RF power signal phase by 360/N, where N is the number of monopole antennae disposed on the single dielectric substrate.

6. The wide beamwidth antenna system of claim 3 having an energy director coupled to the system feed member.

7. The wide beamwidth antenna system of claim 1 further comprising:

a second power splitter, disposed on the first surface of the dielectric substrate and coupled between the first phase shifter and the second one of said plurality of monopole antennae; and a second phase shifter, disposed on the first surface of the dielectric substrate, said second phase shifter being coupled between the second and a next one of said plurality of monopole antennae.

8. The wide beamwidth antenna system of claim 7 wherein the second power splitter directs at least some of the remaining RF power signal from the first power splitter, to the second one of said plurality of monopole antennae.

9. The wide beamwidth antenna system of claim 7 wherein the second phase shifter shifts the remaining RF power signal phase by 360/N, where N is the number of monopole antennae.

10. The wide beamwidth antenna system of claim 1 wherein the plurality of monopole antennae are disposed on the first and the second surface of the single dielectric substrate.

11. A communications device for communicating broad beamwidth signals to and from a device, such as a satellite, said broad beamwidth communications device comprising:

an antenna including:

a flexible dielectric substrate presenting an elongated, tubular portion and having a first and a second surface;

N monopole antennae, without short circuit connection, disposed on at least one surface of the flexible dielectric substrate, where N is an integer greater than 1;

N antenna feed members, disposed on the first surface of the flexible dielectric substrate, for feeding the N monopole antennae with RF power;

a system feed member disposed on the first surface of the flexible dielectric substrate for supplying the antenna system with RF power;

a first power splitter, disposed on the first surface of the flexible dielectric substrate and coupled between the micro-strip feed member and a first one of the N monopole antennae;

a first phase shifter, disposed on the first surface of the flexible dielectric substrate, said first phase shifter being coupled between the first and a second one of said N monopole antennae; and a ground plane disposed on the second surface of the flexible dielectric substrate; and an RF transceiver, coupled to the system feed member for supplying the antenna system with RF power for communication to the satellite.

12. The communications device of claim 11 wherein the antenna comprises:

N−1 power splitters; and

N−1 phase shifters.

13. The communications device of claim 11 wherein the antenna further comprises an energy director integrated into the system feed member.

14. The communications device of claim 13 wherein the energy director is a loop in the system feed member, said loop having a diameter equal to the diameter of the tubular portion of the flexible dielectric substrate.

15. The communications device of claim 11 wherein the antenna further comprises an impedance transformer integrated into the antenna feed members and the system feed member.

16. The communications device of claim 15 wherein the antenna feed members and the system feed member have tapered widths.

17. A method for making a wide beamwidth antenna system comprising the steps of:

providing a single, flexible dielectric substrate having a first and a second surface presenting an elongated, tubular portion;

disposing N monopole antennae without short circuit connection, on at least one surface of the single, flexible dielectric substrate, where N is an integer greater than 1;

disposing an antenna feed system on a first surface of said flexible dielectric substrate by:

fashioning a tapered width system feed member on the first surface of the flexible dielectric substrate, said tapered width feed member for feeding the N monopole antennae, fashioning a power splitter on the first surface of the flexible dielectric substrate, disposed between the system feed member and at least one of the N monopole antennae, fashioning N−1 phase shifters on the first surface of the flexible dielectric substrate, each of said N−1 phase shifters being coupled between two of said N monopole antennae; and disposing a ground plane on a portion of the second surface of the flexible dielectric substrate that is juxtaposed to the antenna feed system.

18. The method of claim 17 further comprising the step of forming the flexible dielectric substrate into the shape selected from the group consisting of:

a tube;

a triangle; and a parallelogram.

19. The method of claim 17 wherein the steps of fashioning and disposing are selected from the group consisting of:

etching;

plating;

printing; and photolithography.

* * * * *